US005416332A

United States Patent [19]

Chen et al.

[11] Patent Number: 5,416,332

[45] Date of Patent: May 16, 1995

[54] INTEGRATED TEST TARGET ASSEMBLY AND COMPACT COLLIMATOR

[75] Inventors: Wallace W. Chen, La Palma; I-Fu Shih, Los Alamitos, both of Calif.

[73] Assignee: Hughes Aircraft Company, Los Angeles, Calif.

[21] Appl. No.: 130,615

[22] Filed: Oct. 1, 1993

[51] Int. Cl.[6] ..... G01D 18/00

[52] U.S. Cl. ..... 250/495.1; 250/494.1

[58] Field of Search ..... 250/495.1, 494.1

[56] References Cited

U.S. PATENT DOCUMENTS 4,387,301 6/1993 Wirick et al. ..... 250/252.1

5,083,034 1/1992 Frank et al. ..... 250/494.1

*Primary Examiner*—Constantine Hannaher

*Attorney, Agent, or Firm*—W. K. Denson-Low

[57] ABSTRACT

An improved wide-spectrum test target assembly, with visual and near IR (infrared) targets integrated with a long wavelength emissivity target. A single relatively thick optical fiber (78) is used to receive target signals emitting from several thinner fibers (72, 74, 76), each carrying a signal of different wavelength. The integrated signal is then relayed to an aperture (108) of an emissivity target through a gradient index lens (88) to further combine with the long wavelength target signal emitted from the emissivity target assembly (100). By selecting appropriate numerical apertures and diameters of the fibers, relatively high power output is achieved. A light collimator (200) is also disclosed for collimating light generated by the test target assembly to simulate targets at infinity. The collimator includes a primary mirror (220) which is an off-axis section of a paraboloidal mirror, a secondary mirror (230) which is an off-axis section of a hyperboloidal mirror, and a support structure/baffle (210) which supports the mirrors in proper relation and also includes an integrated light baffle surface to prevent light from the test target assembly from passing directly to an image plane.

31 Claims, 8 Drawing Sheets

INTEGRATED TEST TARGET ASSEMBLY AND COMPACT COLLIMATOR

FIELD OF THE INVENTION

This invention relates to test equipment for producing target signals used in testing and calibrating such equipment as missile launcher sights, and more particularly to an improved wide-spectrum integrated test target assembly and collimator for such equipment.

BACKGROUND OF THE INVENTION

Test target assemblies provide various target signals at visible, near-IR and far-IR (thermal) wavelengths for calibrating and testing missile launcher sights. The conventional assembly contains an emissivity target plate in the front side and illumination sources placed behind the plate. The emitted test target light is collimated by a collimator assembly for presentation to one or more of the missile launcher sights. The emissivity target plate has a glass substrate coated with a thin layer of chrome on the front surface; the target patterns are created by etching through the chrome layer to expose the glass surface. Due to the different emissivities of chrome and glass, these target patterns provide simulated differential temperature targets, e.g., for the thermal (night) sight of a missile launcher.

Some targets are required to emit not only thermal signals but also visible and near-IR signals needed for testing the day sight and the tracker of a missile launcher. The visible and near-IR signals are provided by illuminating from the back side of the target with appropriate sources.

In one known test target assembly, the central target pattern is a small aperture of 0.0087" diameter which requires illumination from the back side with visible (0.65 μm), 0.9 μm and 1.3 μm wavelength sources. The central boresight target of this test target assembly is illuminated with three LEDs through a coupler including an optical fiber bundle mixer and a homogenizer. The light from three different LEDs is coupled into three thin input fiber bundles of the mixer. The other end of the mixer is a thick output fiber bundle formed by mixing the individual fibers from the three thin bundles. A homogenizer is used to further mix the light from the three different LEDs. The homogenizer is placed directly behind the back side of the target plate without optical relay. The total coupling efficiency of this test target assembly is relatively low. Moreover, in practice, the uniformity of mixing individual fibers in the currently available optical fiber bundle mixers is quite poor; as a result, the irradiance uniformity from the central boresight target is not satisfactory and the boresight test accuracy is reduced. Placing the homogenizer directly behind the target plate without optical relay limits radiation angular spread from the center boresight target aperture. Narrow angular spread results in poor test target performances, i.e., higher boresight error, and difficulty for the missile sight to track the test target. To correct the tracking, the target assembly has to be uniquely designed by pointing the target toward the tracker, which increases assembly difficulty.

SUMMARY OF THE INVENTION

A wide-spectrum integrated test target assembly is disclosed for providing a plurality of test targets at a plurality of wavelengths. The test target assembly includes a plurality of light emitting diodes (LEDs) operating at different wavelengths for producing respective LED light outputs. As an example, three LEDs are used to provide target source light at one visible wavelength (0.65 μm) and two near-IR wavelengths (0.9 μm and 1.3 μm). A plurality of relatively thin input optical fibers conduct light emitted by respective LEDs. The target assembly further includes a single, relatively thick output optical fiber. An optical coupler optically couples the LED light conducted by the thin input optical fibers into the input end of the single output fiber. The output fiber connects to the emissivity target assembly comprising a glass substrate and a target defining layer disposed on the front face of the substrate. The target assembly further includes a target aperture through which the visual, near-IR and long wavelength targets illuminate. The aperture is normally located at the center of the target substrate. A gradient index lens optically relays light emitted from the end face of the output optical fiber to the target aperture.

The output fiber has a length sufficient to obtain uniform energy distribution at the fiber output face. The lens produces sufficient radiation angular spread at the target aperture.

In accordance with another aspect of the invention, a collimator for collimating light generated by a test target source and directing such collimated light to an image plane of an apparatus under test, e.g., a missile sight. The collimator includes a primary mirror comprising an off-axis section of a paraboloidal surface for directing light reflected from a secondary mirror to the image plane. The secondary mirror comprises an off-axis section of a hyperboloidal surface. The collimator further includes a support structure for holding the primary and secondary mirrors and the target source in aligned relationship so that a portion of the light emitted by the source is directed to the secondary mirror, reflected by the secondary mirror to the primary mirror and in turn reflected to the image plane. The support structure further includes an integral light baffle surface for preventing light emitted by the source from passing directly to the image plane.

In accordance with another aspect of the invention, a multi-spectral collimated test system is described comprising in combination an integrated test target assembly and a collimator as described above.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

An improved wide-spectrum integrated test target assembly in accordance with this invention employs a new method of signal coupling to integrate visual and near IR (infrared) targets with a long wavelength emissivity target. A single optical fiber of sufficiently large diameter receives target signals emitted from several thinner fibers, each carrying a signal of different wavelength. The integrated signal is then relayed to the center aperture of the emissivity target through a gradient index lens to further combine with the long wavelength target signal emitted from the aperture. By selecting appropriate numerical apertures and diameters of the fibers, much higher power output is achieved in comparison to test target assemblies employing a fiber bundle mixer and a fused fiber homogenizer.

Figure 1:
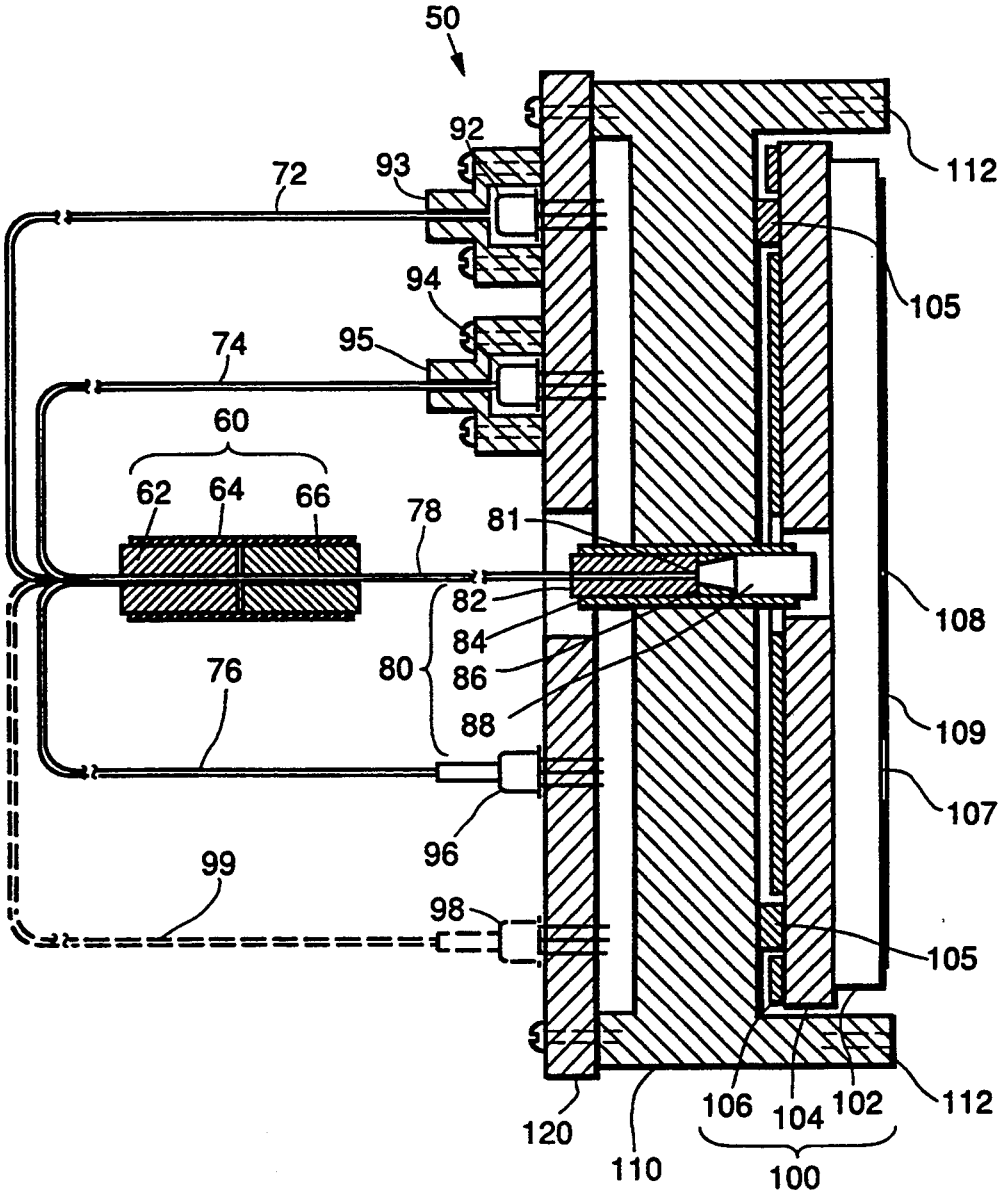
FIG. 1 is a schematic diagram illustrating an improved integrated test target assembly in accordance with the invention.

FIG. 1 illustrates an integrated test target assembly 50 in accordance with this invention. The assembly 50 comprises five major components: (a) an emissivity target assembly 100 as a long wavelength target source; (b) a target frame 110 to support the emissivity target assembly 100; (c) an LED printed circuit assembly 120 functioning as a visual and near-IR target source; (d) a n-to-1, fiber-to-fiber coupler 60 to combine visual and near IR signals; (e) a fiber-to-aperture coupler 80 to project and integrate the combined target signals with the long wavelength target signals emitted from the aperture 108 of the emissivity target assembly 100.

The emissivity target assembly 100 includes a glass substrate 102, a metal plate 104, and a heater pad 106. The glass substrate 102 has a target defining layer 109 made of a low emissivity material, such as chrome, on its front surface 107. The metal plate 104 is fabricated from a material having high thermal conductivity, such as molybdenum, and is attached to the back side of the glass substrate 102 to maintain uniform temperature across the substrate. The thin heater pad 1106 is attached to the back side of the metal plate 104 and is used to heat the glass substrate 102 through the metal plate 104, thus creating an apparent temperature difference between the front surface 107 of the glass substrate and the target defining layer 109.

A target frame 110 made of thermal insulation material, such as MACOR ®, establishes the location of the emissivity target assembly 100 with respect to a mounting flange 112 using epoxy joints 105, such that the front surface of the glass substrate is at the focal plane of a hosting collimator mirror (not shown), which simulates the targets at infinity.

The respective target illumination sources for this embodiment include LED 92 emitting at 0.65 μm, LED 94 emitting at 0.9 μm, and LED 96 emitting at 1.3 μm. The light from the LEDs 92, 94 and 96 is coupled into respective three input fibers 72, 74 and 76. The 0.65 μm visual LED 92, 0.9 μm near-IR LED 94, and a 1.3 μm near-IR LED 96 are installed on the printed circuit board 120. The printed circuit assembly 120 includes a printed circuit board that supports and interconnects the LEDs 92, 94, 96 and 98 to an on-board interface connector (not shown). By adjusting fiber-to-LED distance, fiber-to-LED adapters 93 and 95 set the intensity for the visual and near-IR targets.

A 3-to-1, fiber-to-fiber coupler 60 is formed by joining together the three thin input fibers 72, 74, 76 from one side (coupled to the LEDs 92, 94 and 96, respectively) and a thick output fiber 78 from the other side. The diameters and the numerical apertures of the fibers are chosen to maximize the total coupling efficiency. In a particular exemplary embodiment, for example, the fibers 72, 74 and 76 are each multimode, 100 μm diameter, 0.22 numerical aperture (NA) optical fibers.

A relatively thick output fiber 78 is connected to the output side of the coupler 60. In this example, fiber 78 is multimode, 300 μm thick fiber with a 0.22 NA. A gradient index lens 88 is used to optically relay the end face 81 of the output fiber 78 to the small aperture 108.

The output fiber 78 and the gradient index lens 88 are jointed together by using a sleeve 84 and a spacer 86, as shown in FIG. 1, to hold alignment and proper spacing between them. The output fiber end 81 is prepared by using a ferrule 82 to hold the end; then, the ferrule and the fiber end face are polished together to a high degree of flatness and perpendicularity. The ferrule has its inner diameter equal to the diameter of the output fiber 78 and its outer diameter equal to the diameter of the gradient index lens 88.

Gradient index lenses are rod lenses with graded refractive index profiles. The gradient index lens is different from a conventional lens. While in a conventional lens the ray bending is at the lens' surface only, the ray bending in a gradient index lens is internal and is continuous. The small sizes and flat surfaces of these lenses make the gradient index lenses ideal for fiber-to-aperture coupling. By carefully controlling the distances between the output fiber end face and the lens, and between the lens and the aperture, the visual and near-IR target signals emerge from the same aperture as the long wavelength signal does.

In this example, gradient index lens part number SLW-200-025-130, marketed by NSG America, Inc., 28 World's Fair Drive, Somerset, N.J. 08873, is suitable for the purpose. Precision spacer 86 sets the spacing between the output fiber 78 and the gradient index lens 88. The final spacing between the lens 88 and the aperture 108 is determined during alignment of target irradiance levels, Other types of gradient index lenses may be used provided that the diameter of the lens be the same as the outer diameter of the fiber ferrule (0.079" in this example); that the spacing be re-calculated; and that the length of the spacer 86 be adjusted accordingly. Conventional optical relay lenses, although not as desirable, may alternatively be substituted for the gradient index lens. The gradient index lens has the advantages of flat surfaces and small size.

Since the glass substrate 102 is thick (e.g., on the order of 0.060") compared to the diameter of the small aperture target (e.g., on the order of 0.008"), directly placing the end face 81 of the output fiber 78 behind the substrate 102 will not produce sufficient radiation angular spread. To increase the angular spread, the gradient index lens 88 optically relays the output fiber end face 81 to the small aperture 108. The angular spread must allow the target signals to fill the optical windows of missile launcher sights (not shown) through a hosting collimator mirror system.

To reduce the step of coupling light from an LED to an input fiber, one or more pigtailed LEDs may be used. (A pigtailed LED is an LED with a fiber permanently attached by the manufacturer for optimal coupling efficiency.) The 3-to-1, fiber-to-fiber coupler may then be made directly with these fiber pigtails. However, it may be desirable to use one or more non-pigtailed LEDs so that desired power ratios between different wavelengths can be achieved. FIG. 1 shows a system using pigtailed LED 96, and two LEDs 92 and 94 having adjustable coupling by LED-to-fiber couplers 93 and 95. The LED-to-fiber couplers 93 and 95 provide a means in adjusting signal levels in the respective receiving fibers 72 and 74 by moving the fiber toward or away from the LED. The couplers enable the ratio of signal intensity among different wavelengths to be established. FIG. 1 illustrates a fourth pigtailed LED 98 with fiber 99 for boosting the power at a particular wavelength (1.3 μm in this example) or as a spare.

The 3-to-1 (or n-to-1) fiber-to-fiber coupler 60 is made by first holding the three (or n) thin fibers 72, 74, 76 tightly together with a ferrule 62 having its inner diameter determined by the diameters of the three thin fibers. Similarly, the thick fiber 78 is held tightly by a ferrule 66 with a proper inner diameter. The outer diameters of these two ferrules 62 and 66 are made to be equal. The fiber ends and the holding ferrules are then polished together, to achieve a high degree of flatness and perpendicularity. Finally, the two ferrules are butted together in a sleeve 64 with the inner diameter equal to the outer diameter of the ferrules, and permanently held together by the application of optical epoxy. The thin fiber-to-thick fiber coupling need not be achieved by using precision mechanical means; for example, a fusion method may also be employed to achieve the same goal. Fusion method employs arc welding to permanently join two or more fiber ends together.

The irradiance uniformity of assembly 50 is greatly improved over previously available target test assemblies because the energy distribution at the end face 81 of the output fiber 78 is very uniform, through mode coupling within a single fiber. A typical optical source emits rays at various angles. When the signals traverse along a sufficiently long multimode fiber, there exists a phenomenon of pulse spreading by virtue of different optical path lengths, causing signals to overlap and become indiscernible, thus achieving uniformity, at the end of the fiber. Normally, sufficient mode coupling can be achieved if the length of the output fiber is more than 1 meter; shorter lengths may reduce boresight accuracy.

The total coupling efficiency of this coupling scheme depends on the selection of fiber diameters and numerical apertures (NAs). From commercially available fibers, the input and the output fiber diameters are chosen in this exemplary embodiment to be 100 μm and 300 μm, respectively, based on the considerations of the aperture diameter of the emissivity target (0.0087 inches in this example) and the optimal coupling between input and output fibers. The numerical aperture of both input and output fibers is chosen to be 0.22 for optimal coupling. Although higher NA improves LED-to-fiber coupling efficiency, fiber-to-aperture coupling suffers much higher loss in efficiency. A lower NA will actually improve overall coupling efficiency in a system involving small apertures. The coupling efficiencies at various interfaces are calculated, for three different output fiber diameter and numerical aperture combinations, to be as follows:

| | 400 μm 0.4NA | 300 μm 0.4NA | 300 μm 0.22NA |
|---|---|---|---|
| Input Fiber to Output Fiber | 1.0 | 1.0 | 0.58 |
| Output Fiber to Lens | 0.39 | 0.43 | 1.0 |
| Lens to Emissivity Target | 0.30 | 0.54 | 0.54 |
| Emissivity Target to Missile Sight | 0.0084 | 0.0084 | 0.028 |
| Transmission & Reflection Losses | 0.57 | 0.57 | 0.57 |
| Total Efficiency: | $0.56 \times 10^{-3}$ | $1.11 \times 10^{-3}$ | $5.0 \times 10^{-3}$ |

Figure 2:
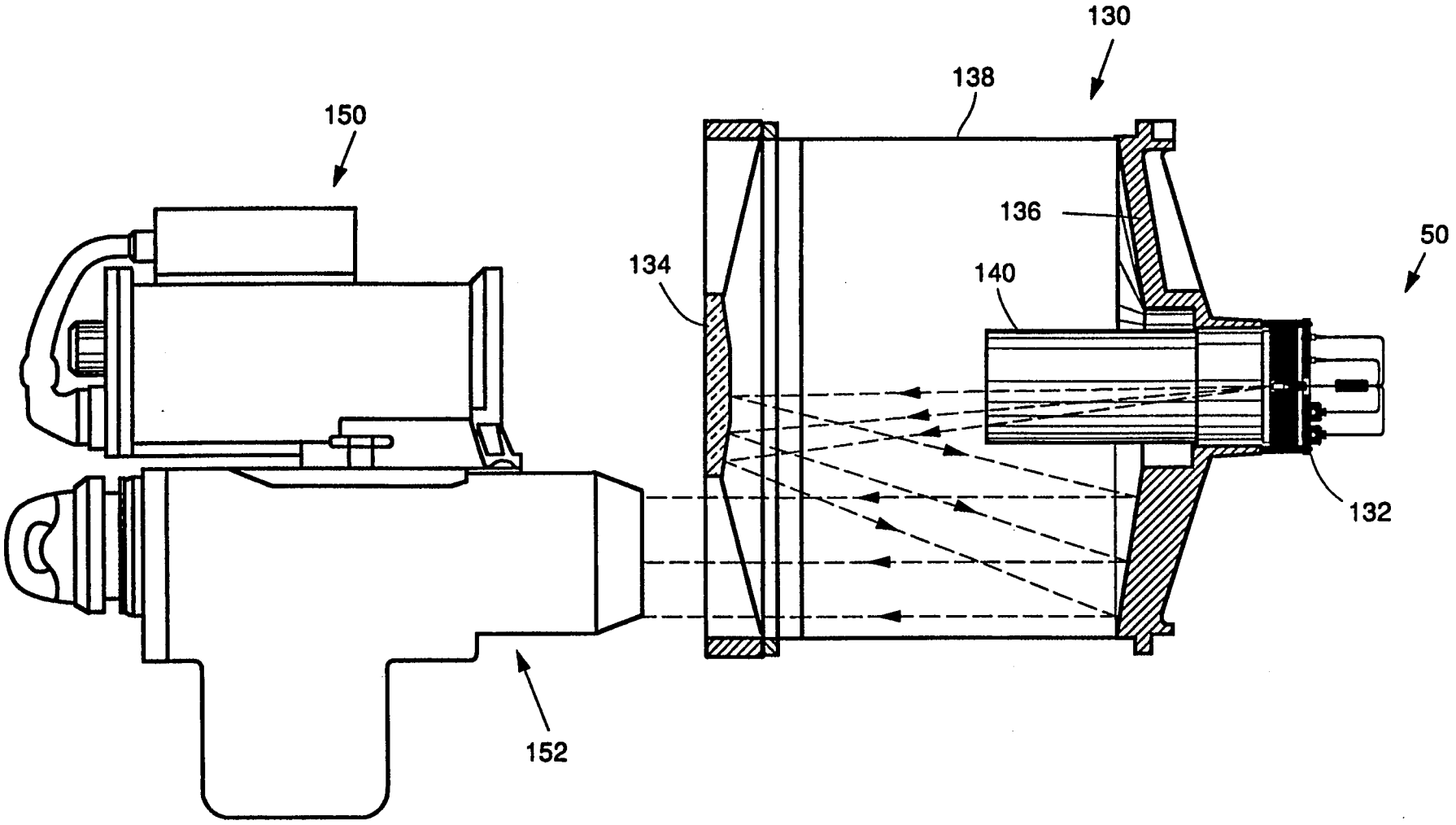
FIG. 2 is a schematic diagram of a collimated target system, including the integrated test target assembly of FIG. 1 in combination with a known Cassegrain mirror collimator system.

An application example of the integrated test target 50 is shown in FIG. 2. In this example, the test target assembly 50 is used to check out boresight alignment and tracking capability of a missile launcher 150. The target assembly 50 is mounted on the focal plane 132 of a Cassegrain mirror collimator system 130 to simulate targets at infinity.

The collimator 130 is an axially symmetric, two-mirror Cassegrain system. This collimator design per se is known in the art. The secondary mirror 134 is machined to a 12"-diameter plate with apertures, and the primary mirror 136 and the secondary mirrors are held together by a 12"-diameter cylindrical tube 138 roughly 10" long. A separate 4"-diameter cylindrical tube 140 is attached to the primary mirror to serve as a light baffle. This collimator provides limited field of view and is physically relatively large.

The collimator mirror need not be a Cassegrain mirror. For example, a single-mirror collimator such as a parabolic mirror can also be used to collimate the targets. In such case, the target assembly cannot be simply attached to the collimator and will require a holding fixture to locate the front surface of the target plate at the focal plane of the collimator mirror.

Figure 3:
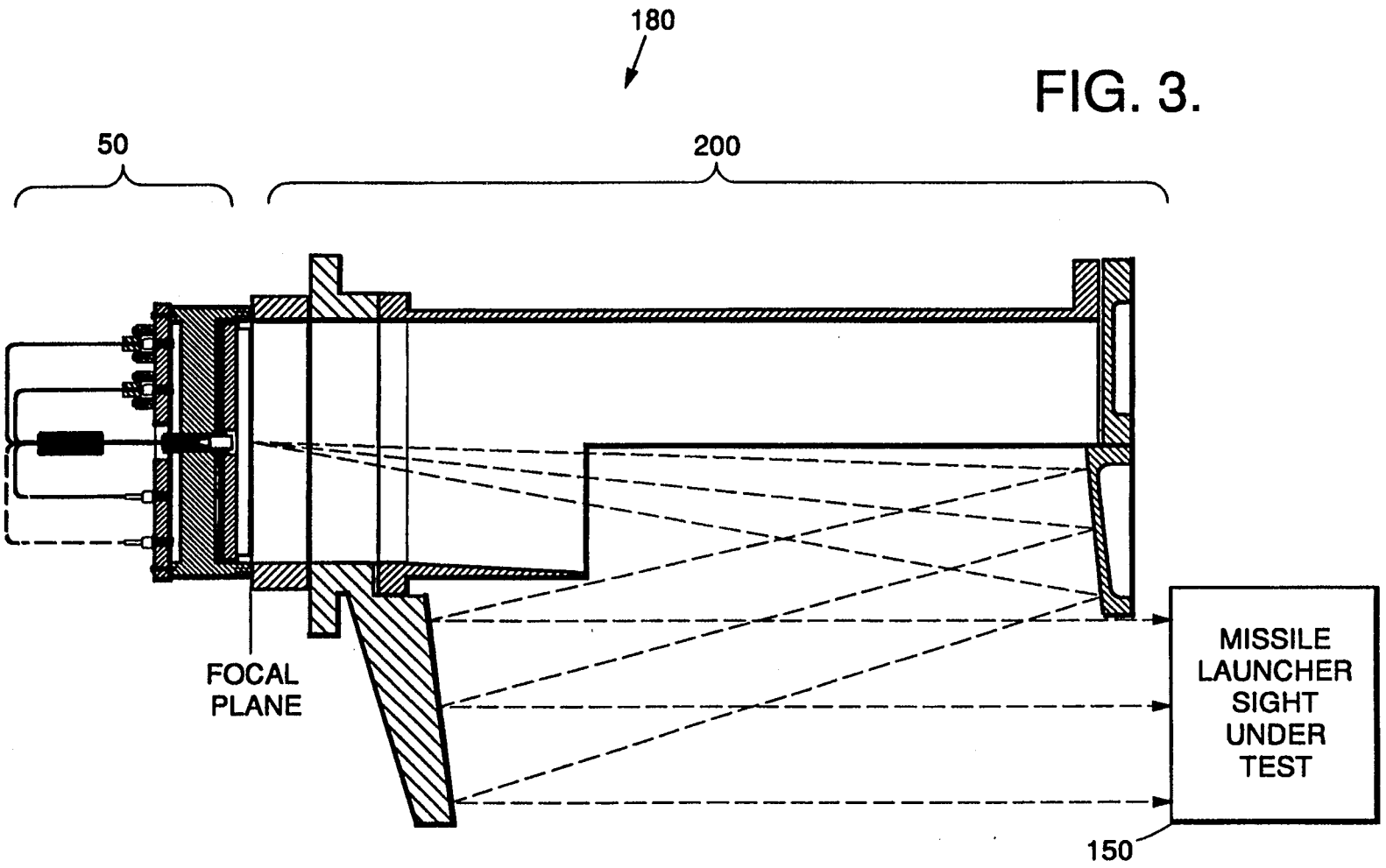
FIG. 3 is a side schematic diagram of a multi-spectral collimated target system in accordance with the invention, employing the integrated test target assembly of FIG. 1 in combination with a new compact collimator assembly.

One exemplary missile sight unit has only two side-by-side apertures (one for day sight and the other for night sight); thus, to test this unit, there is no need to have an axially symmetric Cassegrain system as in FIG. 2. In accordance with another aspect of the invention, a compact collimator assembly 200 is disclosed for testing various functions of a missile launcher sight. The new collimator assembly 200 may be assembled with the integrated test target assembly 50 to provide a multispectral collimated target system 180, as shown in FIG. 3, for testing such apparatus as a missile launcher sight 150. The unit 180 is rigid and yet light weight for use as portable field equipment. To reduce the weight and the volume, only two off-axis sections chosen from a paraboloidal primary mirror and a hyperboloidal secondary mirror are used.

Figure 4:
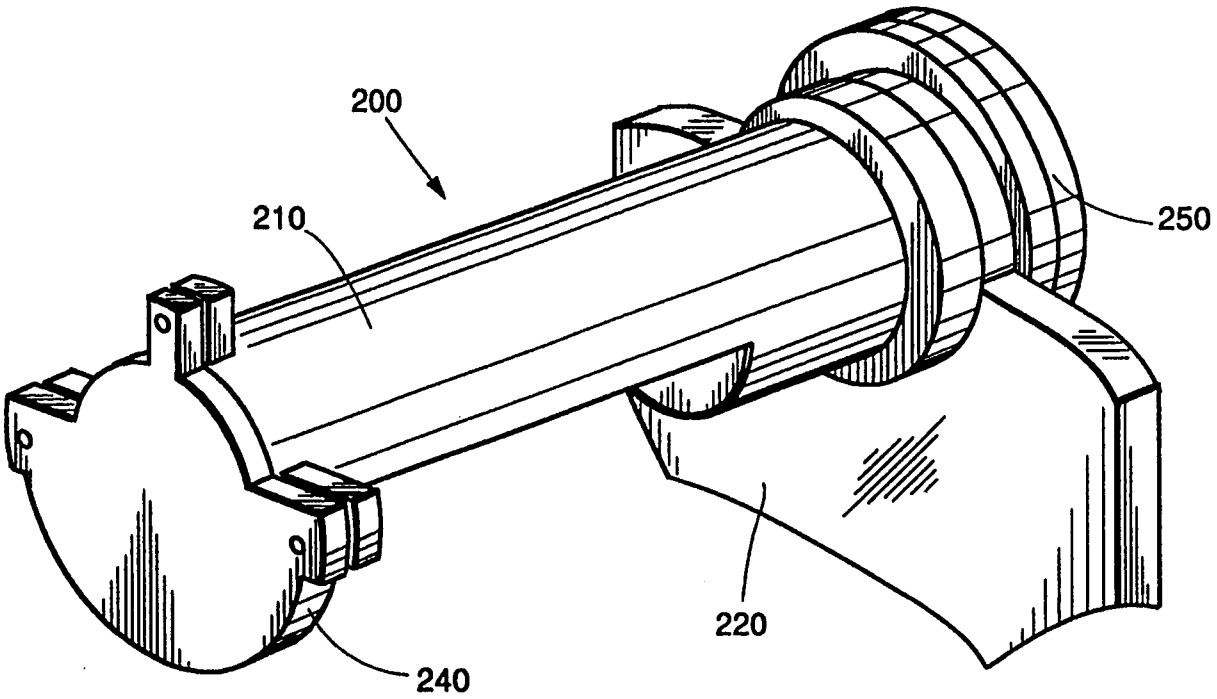
FIGS. 4–9 further illustrate the compact collimator assembly of FIG. 3.
Figure 5:
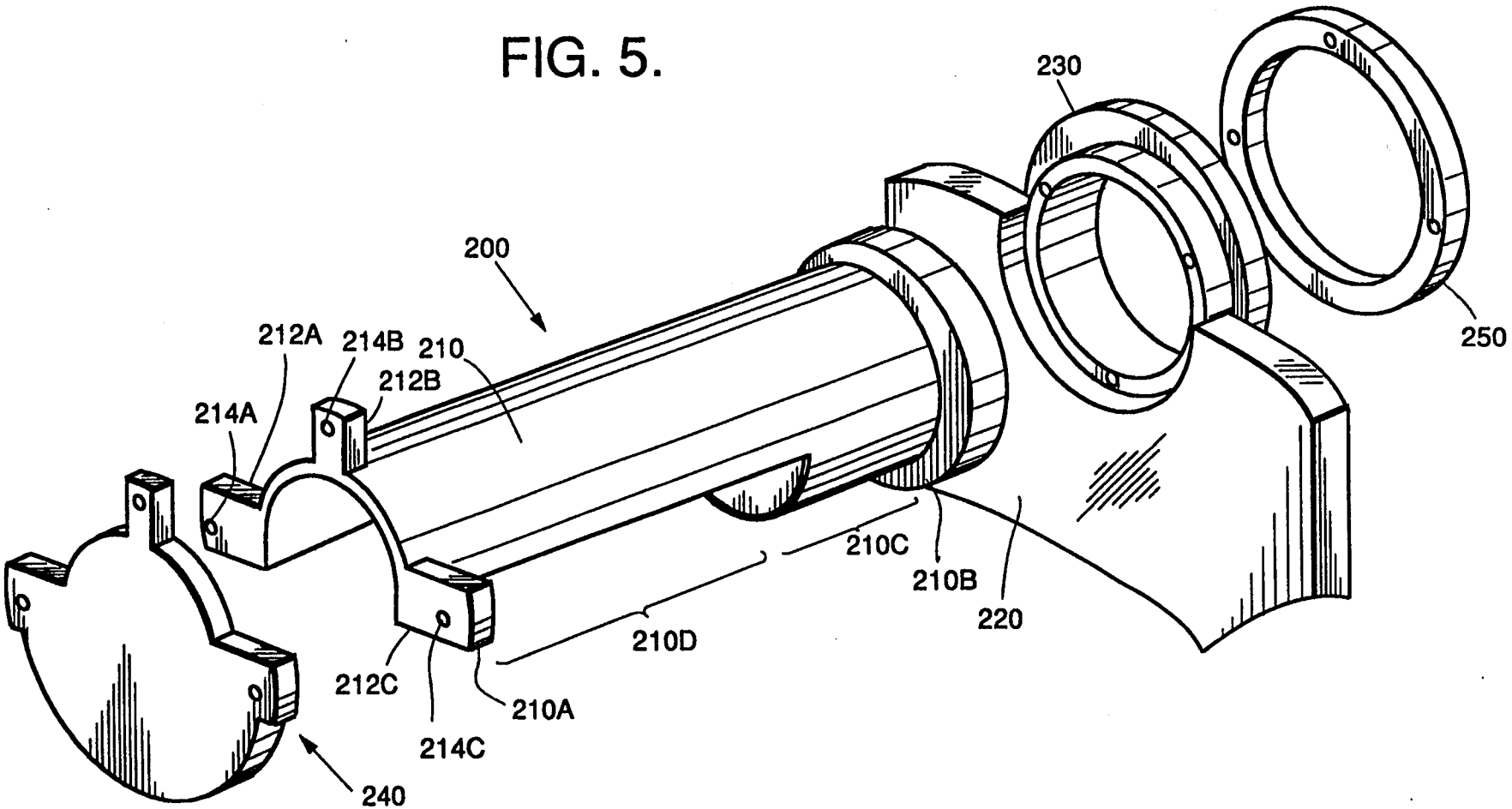

FIGS. 4 and 5 show the appearance and the components of the collimator assembly 200. These components include the support structure/baffle 210, the primary mirror 220 and the secondary mirror 240. The assembly further includes a spacer element 250 attached on the backside of the primary mirror 220. FIG. 4 shows the assembly in an assembled configuration; FIG. 5 shows the assembly in an exploded view.

The support/baffle member 210, as illustrated in FIGS. 4, 5 and 9A–9C, includes a secondary mirror mounting end 210A, a primary mounting end 210B, and intermediate sections 210C and 210D. The section 210C is adjacent the primary mirror mounting end 210B, and comprises a cylindrical tubular section, with end 210B a mounting flange connected to, or integral with, an end of the tubular section. The flange has formed therein threaded openings 224A–224C to receive threaded fasteners 222 to secure the primary mirror 220 thereto. The intermediate section 210D is formed by removing a lengthwise half cylindrical portion of the tubular element. The secondary mirror mounting end 210A is defined by three protruding tabs 212A–212C, which respectively have threaded bores 214A–C formed therein to receive threaded fasteners 247 securing the secondary mirror to end 210A.

Figure 6:
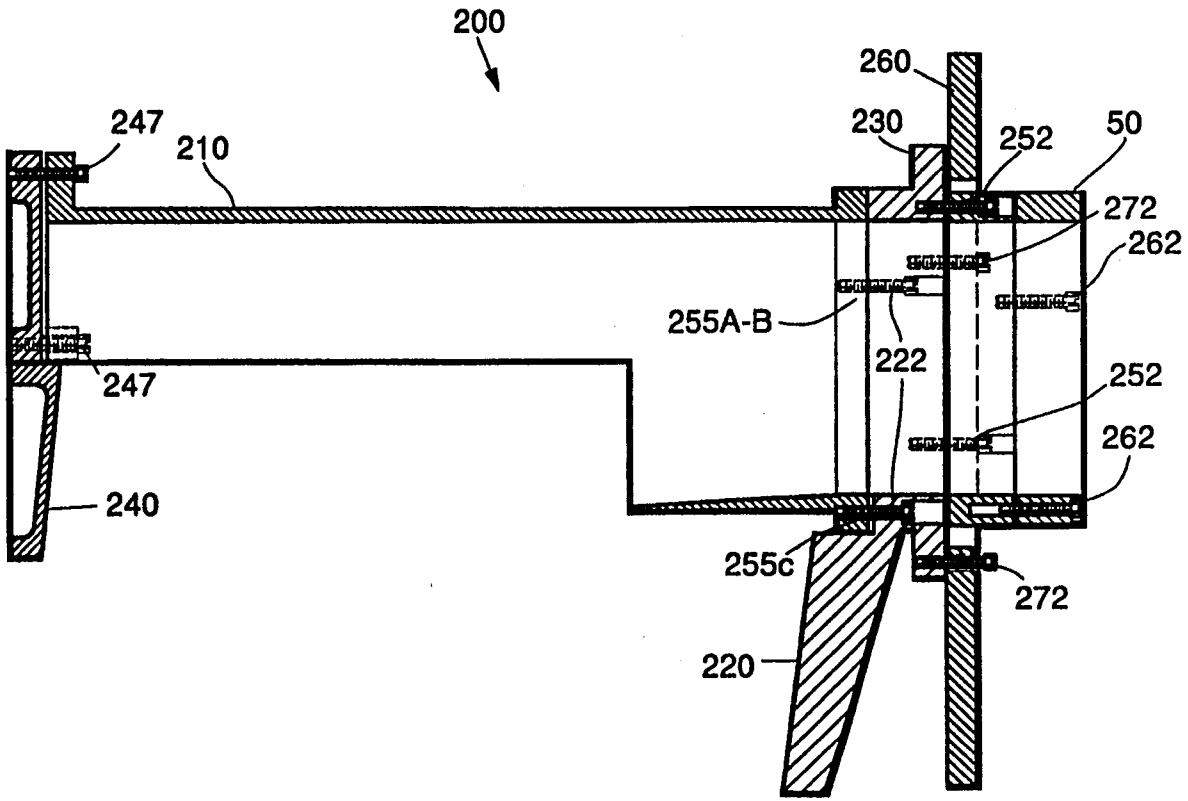

FIG. 6 shows a side cross-sectional view of the collimator assembly 200 designed to the requirements of a particular exemplary embodiment. The effective focal length is chosen to be 40.625". To optimize the optical performance for a field-of-view of 4.2° azimuth by 2.2° elevation, the primary mirror 220 is chosen to have a radius of curvature of 28.1667" with a conic constant of −1.0, the secondary mirror 240 is chosen to have a radius of curvature of 13.2653" with a conic constant of −4.2486, and the vertex distance from the primary mirror to the secondary mirror is chosen to be 9.75". The configuration is also optimized such that the baffle 210 can itself be the holding structure for the primary and the secondary mirrors 220 and 240. Support/baffle structure 210 serves dual purposes, i.e., (a) as a support structure to hold the primary and secondary mirrors in precision position, and (b) as a light baffle to shield and prevent stray light from reaching the emissivity target. For optimal performance of the emissivity target, stray light originating from outside the collimator assembly should be reduced to a minimum. To minimize stray light affecting the emissivity target, sections 210C and the upper portion of section 210D are non-perforated opaque structure. The effect of any stray light that enters through the opening in the lower part of section 210D of the light baffle is minimized by roughing and blackening the internal surface of the light baffle so that minimum light will be reflected to the target.

The spacer 250 is secured to the backside of the primary mirror by threaded fasteners 252. The test target assembly 50 is in turn secured to the spacer by fasteners 262. The integrated target and collimator assembly is then attached to a mounting plate 260 by threaded fasteners 272.

Figure 7:
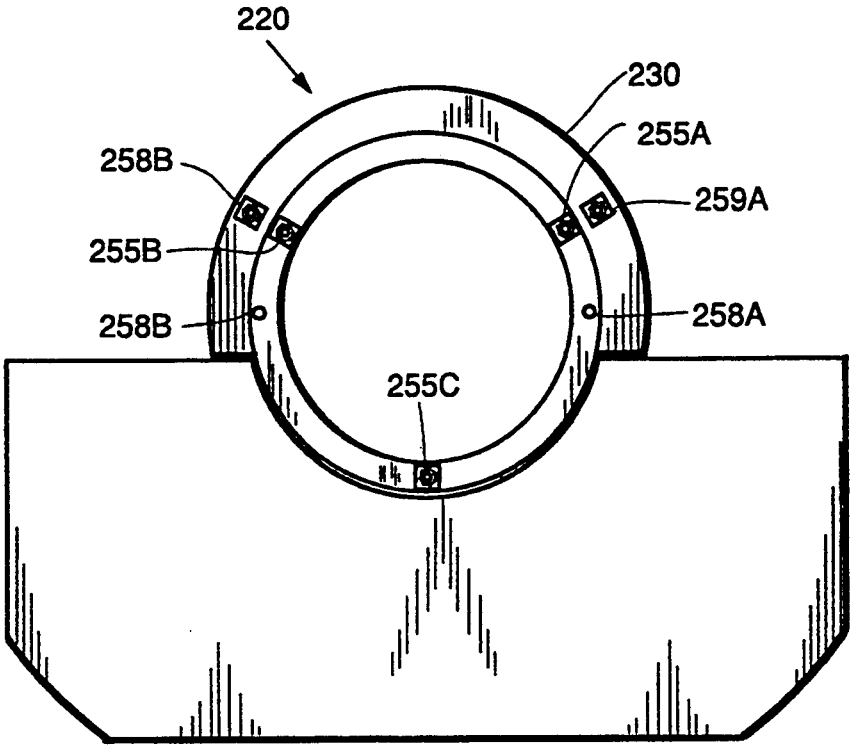

FIG. 7 shows the off-axis section used for the primary mirror 220, chosen from a 13.1"-diameter paraboloidal surface. The primary mirror has integral mounting ring 230 with mounting pads 255A–C and 259A–C, and alignment holes 258A–B. Alignment holes 258A–B accept dowel pins (not shown) to control centering and rotation of the primary mirror with respect to the support structure/baffle 210 through alignment holes 226A–B. The design enables the mirror 220 and the mounting ring 230 to be fabricated as an integral piece using a single point diamond turning machine.

Typical exemplary materials for the collimator assembly include aluminum alloy 6061-T6, silicon carbide, beryllium, and SXA. Material selection depends on collimator application, budget, and weight requirements. Unless weight is an extremely critical factor, aluminum alloy 6061-T6 is a preferred material because it is inexpensive, can be easily machined, and is highly reflective through the visual as well as IR regions.

Diamond turning is a computer-controlled optical finishing process that utilizes a single point diamond tool to produce highly reflective smooth surfaces on a rotating workpiece. Conventional abrasive processes are inherently area-averaging and work best on spherical and flat surfaces. In contrast, the diamond turning is a point defining process that can produce steeply aspherical surfaces. Depending on the shape of the diamond head, the feed rate, and the resolution and stability of the diamond turning machine, the surface finish can be less than 1.0 nanometer rms. The diamond turning process normally requires making a set of blanks using a conventional machining process. For aluminum, an additional step is required to heat treat the blank to improve structural stabilization prior to diamond turning. The mirrors and the support/baffle are individually diamond turned first. The mirrors are attached to the support/baffle with alignment pins to control centering and rotational alignment. The partially finished unit is then measured optically to determine exact thickness of the spacer required to locate the focal plane. The spacer is then diamond turned and attached to the back side of the primary mirror housing ring to complete the collimator assembly.

Figure 8:
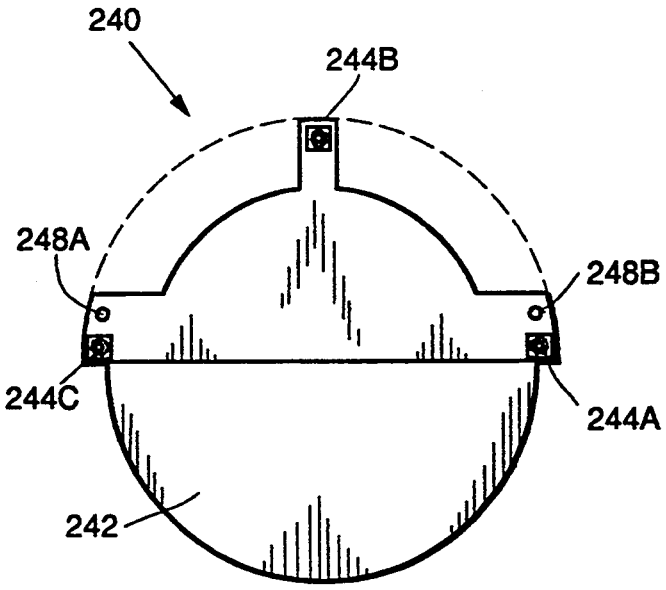
Figure 9C:
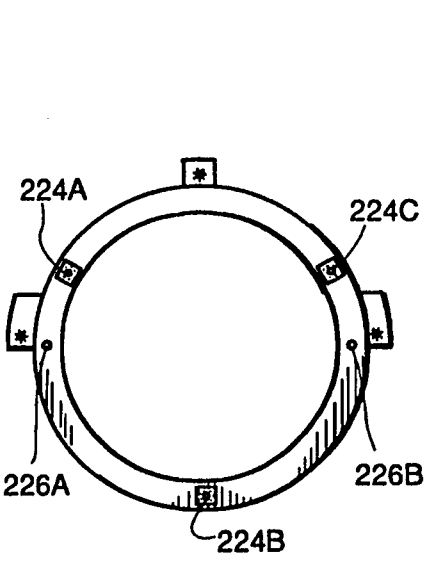
Figure 9B:
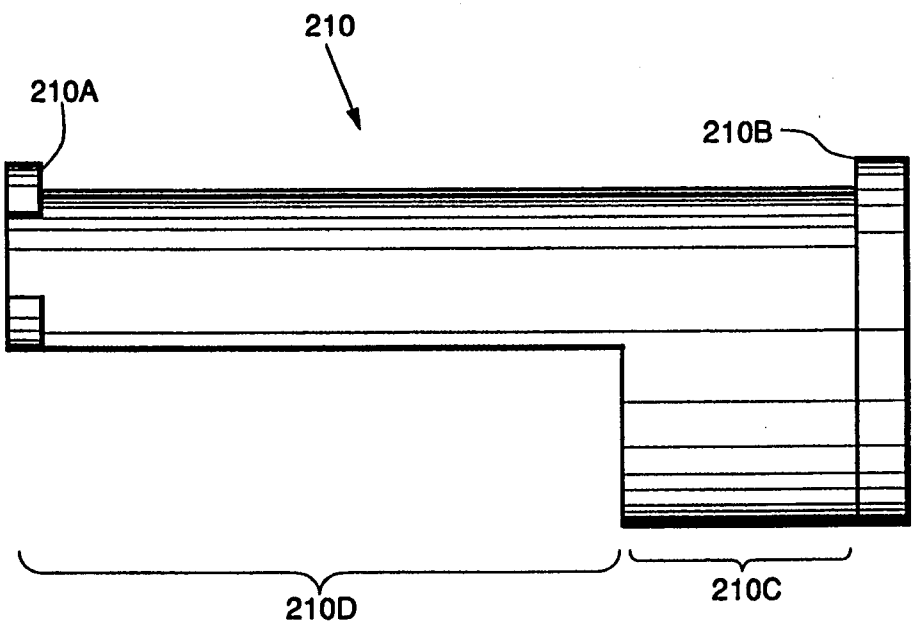
Figure 9A:
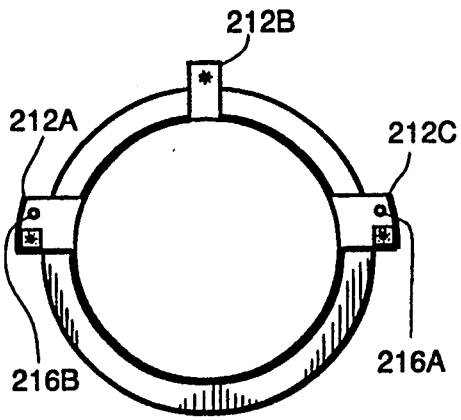

FIG. 8 shows the secondary mirror 240 and its mounting structure that can be made in one piece. The mirror 240 structure includes a mirror surface 242, alignment pads 244A–C, and alignment holes 248A–B. The mirror 240 is secured to support structure/baffle 210 by threaded fasteners 247 or other conventional fastening elements. The alignment holes 248A–B are used to accept dowel pins (not shown) to align with support structure/baffle 210 through alignment holes 216A–B.

One key feature in the above illustrative design is the integration of the holding structure and the baffle into a single piece design, with mirrors mounted to the two ends. The integrated holding structure/baffle results in a compact, rigid, and light weight collimator design. The effectiveness of the baffle is also improved. If the length of the holding structure is greater than the maximum depth travel of a diamond turning machine, the holding structure may be split in the middle. In that case, the interface surface of each half is to be machined together with the respective mirror to maximize mirror assembly accuracy.

The single point diamond turning machine is capable of producing parts with extremely high precision. Optical surfaces and mounting pads can be machined to below micro-inch accuracy, and can be machined in a single process to achieve drop fit assembly without tedious alignment.

In summary, the new collimator is more compact, more rigid, lighter in weight, and has fewer parts compared to traditional collimator designs. While the new collimator has been described for use in conjunction with the new integrated test target 50, it can also be used with other types of test targets.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A wide-spectrum integrated test target assembly for providing a plurality of test targets at a plurality of wavelengths, comprising:

a plurality of light emitting diodes (LEDs) operating at different wavelengths for producing respective LED light outputs;

a plurality of relatively thin input optical fibers for conducting light emitted by said respective LEDs, said input fibers having a low numerical aperture (NA) characteristic;

a single, relatively thick output multimode optical fiber having an output face, said output fiber having a low NA characteristic;

direct optical coupling means for directly coupling said LED light conducted by said plurality of input optical fibers into said output optical fiber, wherein output faces of said input optical fibers are in optical contact with an input face of said output fiber;

said output fiber having a length sufficient to achieve pulse spreading of LED light from said LEDs and provide uniform optical energy distribution at said output face of said output fiber;

a target assembly comprising a glass substrate and a target defining layer disposed thereon, said target assembly further comprising a target aperture, wherein said glass substrate has a thickness dimension at said aperture, and wherein said thickness dimension of said substrate is much larger than a lateral dimension of said target aperture; and means for optically relaying light emitted from said output face of said output optical fiber to said target aperture to increase angular spread of said light emitted at said output face, said optical relaying means including a lens.

2. The assembly of claim 1 wherein diameters defined by said LED connecting optical fibers are smaller than a diameter defined by said output fiber, said optical coupling means comprising means for holding ends of said LED optical fibers tightly together.

3. The assembly of claim 2 wherein said holding means comprises a first ferrule having an inner diameter sufficient to receive ends of said LED connecting fibers, a second ferrule having an inner diameter sufficient to receive an end of said output fiber therein, said ferrules having substantially equal outer diameters, and means for butting said ferrules together.

4. The assembly of claim 3 wherein said butting means comprises a sleeve having an inner diameter equal to said ferrule outer diameter, said ferrules being received therein.

5. The assembly of claim 1 wherein said plurality of LEDs comprise first, second and third LEDs respectively capable of emitting light at visible, first near infrared and second near infrared wavelengths.

6. The assembly of claim 1 wherein said optical relaying means further comprises an optical spacer element inserted between said output face of said output fiber and said lens.

7. The assembly of claim 6 wherein said lens is a gradient index lens having a flat input face, and wherein said output face of said output fiber is flat and perpendicular to said output fiber, and said spacer has flat input and output surfaces, and wherein said flat input surface of said spacer is butted against said output face of said output fiber, and said flat output face of said spacer is butted against said flat input face of said lens.

8. The assembly of claim 1 wherein said lens comprises a gradient index lens.

9. The assembly of claim 1 wherein said length of said output optical fiber is at least one meter.

10. The assembly of claim 1 wherein said input fibers have an NA equal to 0.22, and a nominal diameter dimension of 100 $\mu$m.

11. The assembly of claim 1 wherein said output fiber has an NA equal to 0.22, and a nominal diameter dimension of 300 $\mu$m.

12. A wide-spectrum integrated test target assembly for providing visible, near-IR and far-IR test targets, comprising:

first, second and third light emitting diodes (LEDs) operating respectively at wavelength desired for producing visible and near-IR light outputs;

first, second and third relatively thin input optical fibers for conducting light emitted by said respective LEDs, said input fibers having a low numerical aperture (NA) characteristic;

a single, relatively thick output optical fiber having an output face, said output fiber having a low NA characteristic;

direct optical coupling means for directly coupling said LED light conducted by said first, second and third input optical fibers into said output optical fiber, wherein output faces of said input optical fibers are in optical contact with an input face of said output fiber;

said output fiber having a length sufficient to achieve pulse spreading of LED light from said LEDs and provide uniform optical energy distribution at said output face of said output fiber;

a target assembly comprising a glass substrate and a target defining layer disposed on a front face of said substrate, said target assembly further comprising a target aperture through which said visible, near-IR and far-IR test targets illuminate, wherein said glass substrate has a thickness dimension at said aperture, and wherein said thickness dimension of said substrate is much larger than a lateral dimension of said target aperture; and means for optically relaying light emitted from said output face of said output optical fiber to said target aperture to increase angular spread of said light emitted at said output face, said optical relaying means including a gradient index lens.

13. The assembly of claim 12 wherein diameters defined by said LED connecting optical fibers are smaller than a diameter defined by said output fiber, said coupler comprising means for holding ends of said LED optical fibers tightly together.

14. The assembly of claim 13 wherein said holding means comprises a first ferrule having an inner diameter sufficient to receive ends of said input optical fibers, a second ferrule having an inner diameter sufficient to receive an end of said output fiber therein, said ferrules having substantially equal outer diameters, and means for butting said ferrules together.

15. The assembly of claim 14 wherein said butting means comprises a sleeve having an inner diameter equal to said ferrule outer diameter, said ferrules being received therein.

16. The assembly of claim 12 wherein said optical relaying means further comprises an optical spacer element inserted between said output face of said output fiber and said lens.

17. The assembly of claim 16 wherein said gradient index lens has a flat input face, and wherein said output face of said output fiber is flat and perpendicular to said output fiber, and said spacer has flat input and output surfaces, and wherein said flat input surface of said spacer is butted against said output face of said output fiber, and said flat output face of said spacer is butted against said flat input face of said lens.

18. The assembly of claim 12 wherein said length of said output optical fiber is at least one meter.

19. The assembly of claim 12 wherein said input fibers have an NA equal to 0.22, and a nominal diameter dimension of 100 μm.

20. The assembly of claim 12 wherein said output fiber has an NA equal to 0.22, and a nominal diameter dimension of 300 μm.

21. A multi-spectral test target system, comprising:

a wide-spectrum integrated test target assembly for providing a plurality of test targets at a plurality of wavelengths, comprising:

a plurality of light emitting diodes (LEDs) operating at different wavelengths for producing respective LED light outputs;

a plurality of relatively thin input optical fibers for conducting light emitted by said respective LEDs, said input fibers having a low numerical aperture (NA) characteristic;

a single, relatively thick output multimode optical fiber having an output face, said output fiber having a low NA characteristic;

direct optical coupling means for directly coupling said LED light conducted by said plurality of input optical fibers into said output optical fiber, wherein output faces of said input optical fibers are in optical contact with an input face of said output fiber;

said output fiber having a length sufficient to achieve pulse spreading of LED light from said LEDs and provide uniform optical energy distribution at said output face of said output fiber;

a target assembly comprising a glass substrate and a target defining layer disposed on a front face of said substrate, said target assembly further comprising a target aperture, wherein said glass substrate has a thickness dimension at said aperture, and wherein said thickness dimension of said substrate is much larger than a lateral dimension of said target aperture; and means for optically relaying light emitted from said output face of said output optical fiber to said target aperture to increase angular spread of said light emitted at said output face, said optical relaying means including a lens; and collimating means for collimating said light relayed to said target aperture so as to simulate targets at infinity.

22. The system of claim 21 wherein diameters defined by said LED connecting optical fibers are smaller than a diameter defined by said output fiber, said coupler comprising means for holding ends of said LED optical fibers tightly together.

23. The system of claim 22 wherein said holding means comprises a first ferrule having an inner diameter sufficient to receive ends of said LED connecting fibers, a second ferrule having an inner diameter sufficient to receive an end of said output fiber therein, said ferrules having substantially equal outer diameters, and means for butting said ferrules together.

24. The system of claim 23 wherein said butting means comprises a sleeve having an inner diameter equal to said ferrule outer diameter, said ferrules being received therein.

25. The system of claim 21 wherein said plurality of LEDs comprise first, second and third LEDs respectively capable of emitting light at visible, a first infrared and a second infrared wavelengths.

26. The system of claim 21 wherein said optical relaying means further comprises an optical spacer element inserted between said output face of said output fiber and said lens.

27. The assembly of claim 26 wherein said lens is a gradient index lens having a flat input face, and wherein said output face of said output fiber is flat and perpendicular to said output fiber, and said spacer has flat input and output surfaces, and wherein said flat input surface of said spacer is butted against said output face of said output fiber, and said flat output face of said spacer is butted against said flat input face of said lens.

28. The system of claim 21 wherein said lens comprises a gradient index lens.

29. The assembly of claim 21 wherein said length of said output optical fiber is at least one meter.

30. The assembly of claim 21 wherein said input fibers have an NA equal to 0.22, and a nominal diameter dimension of 100 μm.

31. The assembly of claim 21 wherein said output fiber has an NA equal to 0.22, and a nominal diameter dimension of 300 μm.

* * * * *